US005682587A

United States Patent [19]

Higeta et al.

[11] Patent Number: 5,682,587

[45] Date of Patent: Oct. 28, 1997

[54] DEVELOPING APPARATUS USING HOLLOW MAGNET ROLLER

[75] Inventors: Akira Higeta, Funabashi; Kazuyoshi Odagawa, Koshigaya; Tadayuki Tsuda, Tokyo; Shinichi Sasaki, Fujisawa; Isao Ikemoto, Kawasaki, all of Japan

[73] Assignee: Canon Kabushiki Kaisha, Tokyo, Japan

[21] Appl. No.: 500,430

[22] Filed: Jul. 10, 1995

[30] Foreign Application Priority Data

Jul. 8, 1994 [JP] Japan ..... 6-179788

[51] Int. Cl.[6] ..... G03G 15/09

[52] U.S. Cl. ..... 399/277

[58] Field of Search ..... 355/245, 251, 355/253, 259; 48/653; 399/275, 276, 277

[56] References Cited

U.S. PATENT DOCUMENTS

| | | | |
|---|---|---|---|
| 3,981,271 | 9/1976 | Okada et al. | 118/637 |
| 4,708,455 | 11/1987 | Kubota et al. . | |
| 5,105,226 | 4/1992 | Sugihara | 355/251 |
| 5,196,889 | 3/1993 | Ronnenberg et al. | 355/259 |
| 5,294,960 | 3/1994 | Nomura et al. | 355/210 |
| 5,461,464 | 10/1995 | Swain | 355/211 |
| 5,465,138 | 11/1995 | Jaskowiak et al. | 355/245 |
| 5,498,837 | 3/1996 | Yamashita | 118/658 |

OTHER PUBLICATIONS

Xerox Disclosure Journal, vol. 6, No. 1, Jan./Feb. 1981, "Neck Down Flow Form Mag Brush Roll & Core".

*Primary Examiner*—William J. Royer

*Attorney, Agent, or Firm*—Fitzpatrick, Cella, Harper & Scinto

[57] ABSTRACT

A developing apparatus includes a developing sleeve for carrying a developer; a hollow magnet roller in the sleeve; a supporting member inserted into the developing sleeve and the magnet roller to support an inside surface of the developing sleeve and the magnet roller.

7 Claims, 9 Drawing Sheets

DEVELOPING APPARATUS USING HOLLOW MAGNET ROLLER

FIELD OF THE INVENTION AND RELATED ART

The present invention relates to a developing apparatus usable with an image forming apparatus such as a printer or copying machine, for developing an electrostatic image of an image bearing member.

FIG. 9 shows a sectional view of a neighborhood of a developing sleeve of a developing apparatus. As shown in FIG. 9, it has a developing sleeve 12 in the form of a non-magnetic hollow cylinder, bearings 18 for bearing the developing sleeve 12, and a magnet 19 in the developing sleeve 12. The developing sleeve 12 has sleeve flanges 15 and 17 bonded thereto, and the bearings 18 rotatably support the sleeve flanges. The bearings 18 are mounted on a holder 21. Through the bearings 18, the developing sleeve 12 is supported on a frame (not shown). In holder 21 at one end, there is provided a sleeve gear 12*a* to transmit the rotation of the photosensitive drum (not shown) to the developing sleeve 12. One end of the magnet 19 is securedly supported on the holder 21, and the other end is supported by a bearing 21 press-filled to the sleeve flange 17, so that the positions of the magnetic poles do not change. To the developing sleeve 12, a developing bios voltage is applied through the bearings 18, 22 from the main assembly of the image forming apparatus.

In such a conventional developing apparatus, the developing sleeve 12, sleeve flange 15 and sleeve flange 17 are machined from non-magnetic aluminum material blank with very high precision. The bearings 18 and 22 are expensive ball bearings to permit high precision rotation of the developing sleeve 12.

The description will be made as to a conventional process cartridge for an image forming apparatus such as a copying machine or a laser beam printer, wherein the process cartridge is detachably mountable relative to the main assembly of the image forming apparatus to facilitate maintenance of the apparatus. In such a process cartridge, the developing apparatus for developing an electrostatic latent image on the image bearing member in the form of a photosensitive drum with developer (toner), is similarly provided with a developing roller having a developing sleeve and a magnet to supply the toner to the photosensitive drum using the magnetic force from the developing apparatus.

As shown in FIG. 10, the developing roller comprises a developing sleeve 100 and magnet roller 101 having a plurality of magnetic poles N1, N2, S1 and S2, as shown in FIG. 11. An end 101*a* of magnet roller 10, as shown in FIG. 10, has a shape provided by cutting a part of a cylindrical core. The flat portion provided by the cutting is used to correctly position the plurality of more particularlys relative to the developing apparatus 110. The core portion 101*d* is fixed to a holder 111*a*. The other end 101*b* of the magnet roller 101 is fixed to a holder 111*b*, which is fixed to a main assembly of the 110 of the apparatus. The developing sleeve 100 is disposed to cover the magnet roller 101 with a small gap with the magnet 101*c* of the magnet roller 101 of the developing sleeve 100, and the opposite end portions are rotatably supported on the main assembly of the apparatus by way of bearings 102. In this apparatus, the thrust force of the magnet roller 101 is received by abutment of the end surfaces of the core 101*a* and 101*b* to holders 111*a* and 111*b*.

As shown in FIG. 12 and FIG. 13, the developer chamber 303 is provided with a rotatable pipe-like developing sleeve

301. The developing sleeve 301 contains therein with a magnet roller 304, of a magnet having a plurality of magnetic pole. To the developing sleeve 301, a development blade 302 mounted to developing container 305 is contacted.

The developing sleeve 301 is urged to the photosensitive drum 306 through spacer roller s 307*a*, 307*b* which functions to maintain a predetermined gap with the photosensitive drum 306 as the image bearing member.

A flange 313 is fitted into the pipe of the developing sleeve 301 at an end thereof, and the flange 313 is supported by a bearing 311*a*. To the other end of the d developing sleeve 301, as described above, a spacer roller 307*b* is mounted to the outside thereof, and the outer part of the spacer roller 307*b* is supported by a bearing 311*b*. On the other hand, the magnet roller has an extension of the shaft which is securely fixed to the developing container 305.

To an end of the developing sleeve 301, a sleeve gear 312 for rotating the developing sleeve 301 in a predetermined direction is mounted, and the sleeve gear 312 is driven by a drum gear 316 bonded or press-fitted to the photosensitive drum 306 to be rotated in a predetermined direction.

In order for sufficient meshing to provide proper driving force, there are helical gears. By using the helical gears, the thrust force resulting from the gears are positively used to urge the developing sleeve 301 in a predetermined direction.

In this developing device, the position provided by the thrust urging force is taken as a reference position for the design of the developing sleeve 301. Referring to FIG. 13, the gears of the sleeve gear 312 are twisted leftwardly, and the drum gear 316 is twisted rightwardly, so that the drum gear is rotated in the direction indicated by arrow a. The sleeve gear 312 receiving the driving force receives the thrust force resulting form the above described twisting directions in the direction of an arrow b, so that the sleeve gear 312 and flange 313 are brought into contact with the surface of the developing container 305. The amount of this movement results from the gap required for assembling and from the tolerances for parts, it cannot be reduced to zero. The position where it is contacted to the surface of the developing container 305 is taken as the reference position of the design.

In such a developing device, the toner functioning as developer is supplied to the developer chamber 303 through inlet opening portion 308 of the developer chamber 303 by the gravity or feeding means (not shown) from the toner container (not shown). Then, the toner of the developer chamber 303 is attracted to the one of the magnetic poles of the magnet roller 304 (N1) and is stirred by the developing sleeve 301 being rotated. By this, it is gradually charged, and apart thereof is fed in the direction shown by an arrow indicated in FIG. 13. The toner is introduced into a gap between the developing sleeve 301 and is strongly urged to the developing sleeve 301 so as to be further charged electrically with the result that the amount of the electric charge abruptly increases. With the rotation of the developing sleeve 301 it is discharged to the outside of the developer chamber 303. In addition to the increase of the charge amount, the development blade 302 is effective to regulate the thickness of the toner layer on the developing sleeve 301.

Most of developing sleeves 301 are of a conductive member such as aluminum alloy, and an end thereof is provided with a bias plate 309, as shown in FIG. 13 inside the developing sleeve so as to permit electric energy supply to the developing sleeve 301 from an unshown developing bias electric energy supply portion of the image forming apparatus the main assembly.

Therefore, the toner supplied from the developer chamber 303 through the developing sleeve 301 transfers onto the electrostatic latent image on the photosensitive drum 306 so as to develop the electrostatic latent image.

The toner not used for the development is returned to the developer chamber 303 by the rotation of the developing sleeve 301.

The bias plate 309 for applying the bias voltage, as shown in FIG. 14 and 15, is contacted to the inner wall of the developing sleeve 301 through claw portion s 309*a*, 309*b*, 309*c*, 309*d* so that it is securely fixed, and is electrically connected to the developing sleeve 301. The bias plate 309 is provided with arm portions 309*a*, 309*f*, which are electrically contacted to the electrode plate 314 in the developing container 305 of the process cartridge. The electrode plate 314 is contacted to a developing bias contact portion of the image forming apparatus of the main assembly, when the process cartridge is mounted in the image forming apparatus of the main assembly, so as to be supplied with electric energy from a developing bias electric energy supply device (not show).

The bias plate 309 determined a contact pressure upon contact with the electrode plate 314 so as to be supplied with the electric energy when the developing sleeve 301 is at the design reference positional.

As described above, in the conventional image forming apparatus, various types of developing devices are used, and they are generally satisfactory.

With use of the shaft integral type magnet roller, the following problems arise.

In order to provided a predetermined magnetic force on the developing sleeve surface, the gap between the sleeve inner surface and the magnet is preferably small, and the variation of the gap change due to the rotation of the sleeve is preferably small. However, in the prior art example, the developing sleeve and the magnet are mounted through a plurality of parts, the unavoidable errors of the parts and the mounting errors have to be taken into account, with the result that the reduction of the variation of the gap is limited. In order to maintain the intensity of the magnetic force which is reversely proportional to the square of the distance from the magnet, the magnet has to be given a stronger magnetic force. Additionally, the large variation means larger variation of the magnetic force.

In the above described example, the inside wall surface of the sleeve has to have a bias plate to supply the developing bias to the developing sleeve, and the electrode has to the mounted to be developing container, which are required only to supply the bias voltage. Thus, the number of parts and the steps of assembling operation increase.

SUMMARY OF THE INVENTION

It is a principal object of the present invention to provide a developing device wherein the number of parts and number of assembling steps are small.

It is an object of the present invention to provide a developing device wherein the positional accuracy between the developing sleeve and magnet roller is high.

According to an aspect of the present invention there is provided a developing apparatus comprising: a developing sleeve for carrying a develope; a hollow magnet roller in said sleeve; a supporting member inserted into said developing sleeve and said magnet roller to support an inside surface of said developing sleeve and said magnet roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Figure 1:
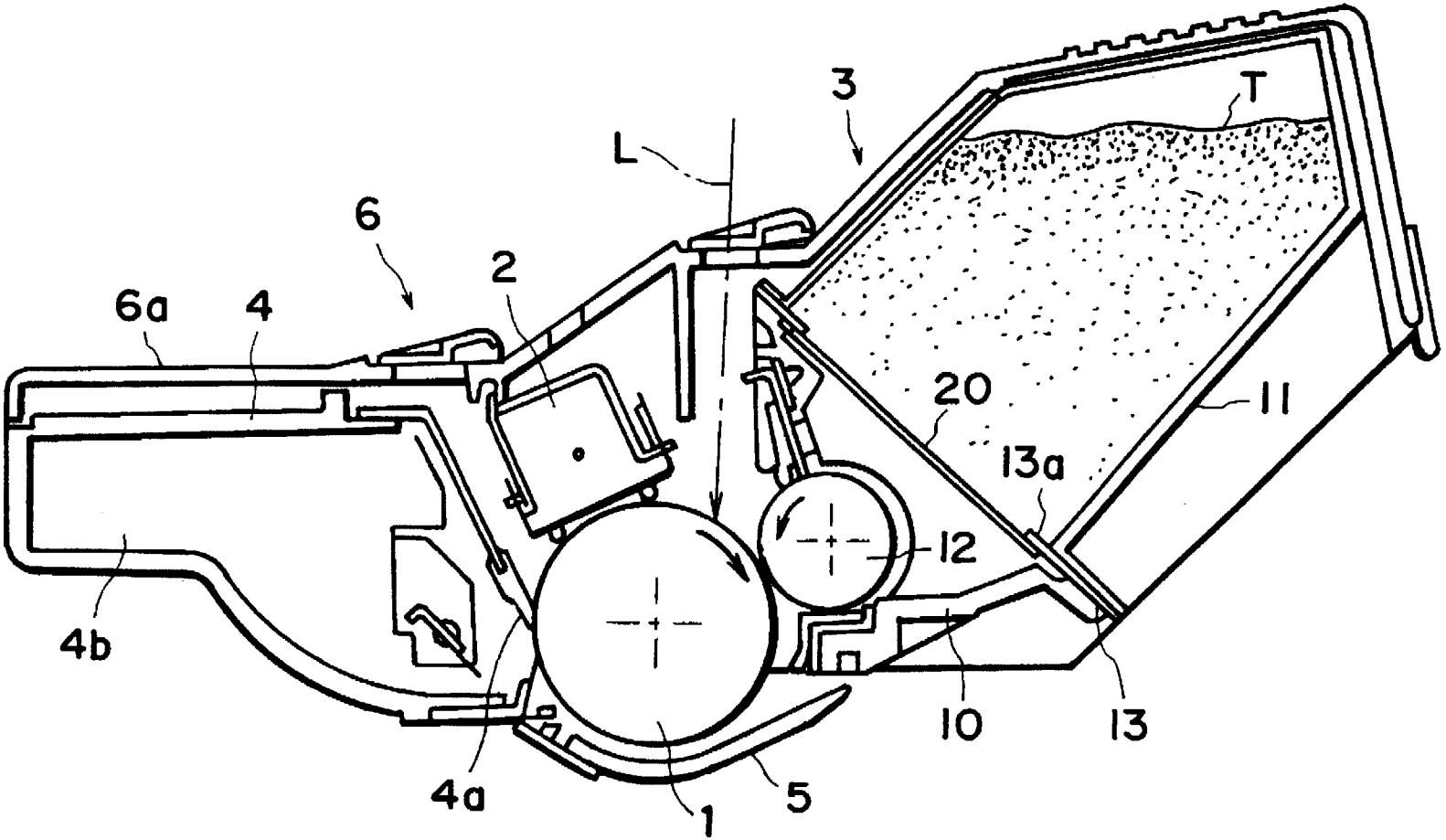
FIG. 1 is a sectional view of a process cartridge using a developing device according to an embodiment of the present invention.
Figure 2A:
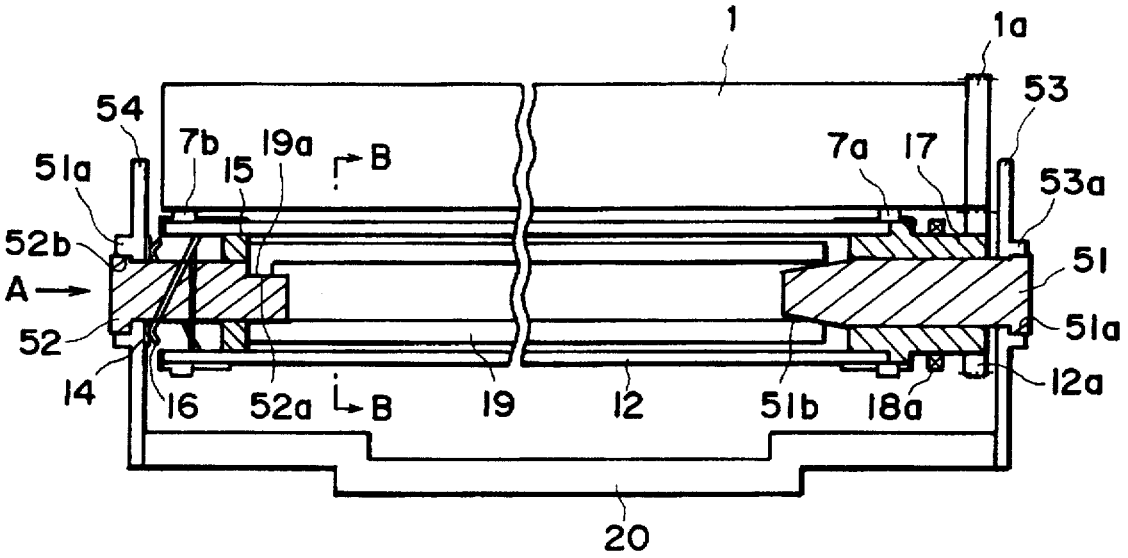
FIGS. 2(*a*), (*b*), and (*c*) are sectional views of a developing device.
Figure 2B:
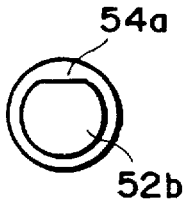
Figure 2C:
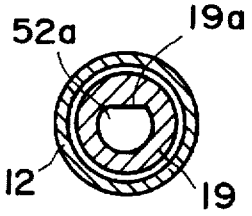
Figure 3:
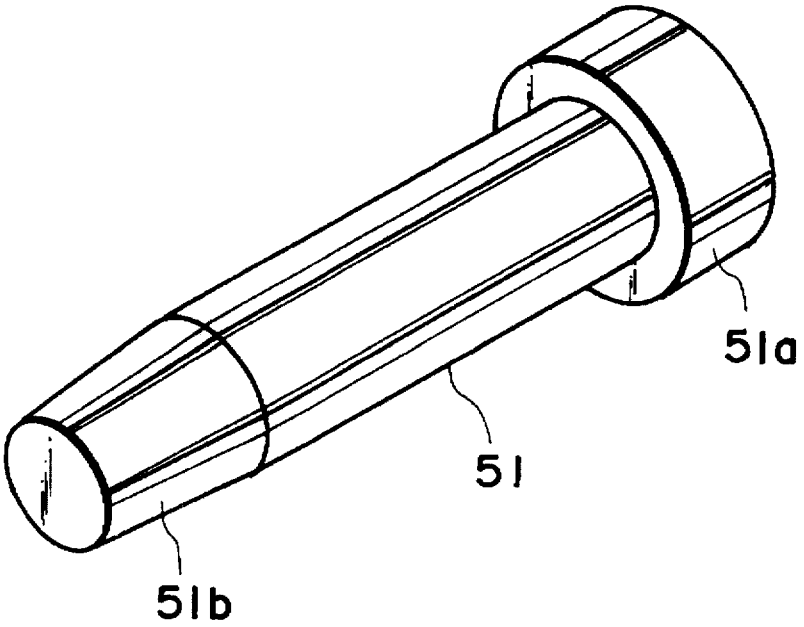
FIGS. 3 and 4 are perspective views of supporting member.
Figure 4:
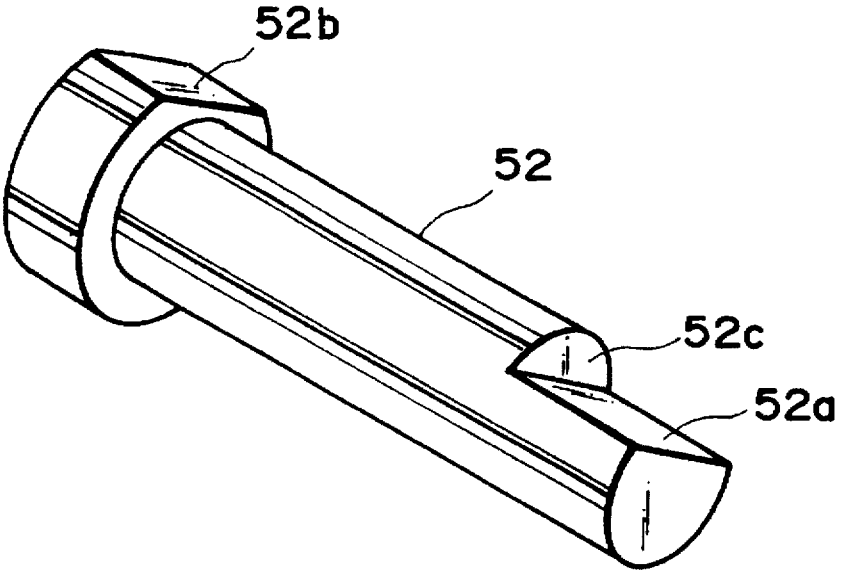

FIGS. 1–4 show a first embodiment of the present invention. FIG. 1 is a sectional view of a process cartridge integrally having a developing device and a photosensitive member. FIG. 2 is a partially sectional view of the developing device thereof, and FIGS. 3 and 4 are perspective views of a supporting member.

In FIG. 1, designated by reference numeral 1 is an image bearing member in the form of photosensitive drum rotatable in a direction of an arrow, and around the photosensitive drum 1, there are provided a charger 2, a developing device 3 and a cleaning device 4 (process means). The process means are integrally contained in a cartridge container 6*a*, and the process cartridge is mounted to the main assembly of the apparatus. By doing so, the maintenance operations are simplified since the entirety of the process cartridge 5 can be exchanged when the service life of the photosensitive drum 1 ends, or when the toner (developer) in developing device 3 is used up.

The developing device 3 comprises a developing zone 10 having a developing sleeve 12 as the developer carrying member faced to the photosensitive drum 1 side, and a developer accommodation portion 11 for supplying the toner to the developing zone 10. Between the developing zone 10 and the developer accommodation portion 11, a cap member 13 having an opening portion 13*a* is sandwiched. A seal device 20 which will be described hereinafter is mounted to the opening portion 13*a* of the cap member 13. This is effective to prevent the toner T from moving to developer accommodation portion 11 and leaking out of the process cartridge 6. Additionally when the process cartridge 6 is mounted to the main assembly of the image forming apparatus, the seal device 20 is operated to open the opening portion 13*a*, by which the toner is supplied to the developing zone 10.

The cleaning device 4 is in contact with the photosensitive drum 1, and comprises a cleaning blade 4*a* for removing the remaining toner from the photophotosensitive drum 1 and a residual toner accommodation portion 4*b* for accommodating residual toner removed by the cleaning blade 4*a*. It removes the remaining toner from the photosensitive drum 1 to prepare it for the next image forming operation.

When the process cartridge is mounted to the main assembly, a shutter 5 for protecting the photosensitive drum 1 is retracted to a side of the photosensitive drum 1 (below the cleaning device 4).

In the apparatus of this embodiment, image light L is projected through unshown scanning optical system onto the photosensitive drum 1 which has been uniformly charged by the charger 2. The electrostatic latent image is moved toward the developing device 3 with the rotation of a photosensitive drum 1, and the toner T is supplied thereto by developing sleeve 12 of the developing device 3 so that it is visualized into a toner image. The toner image is transferred onto a transfer material by unshown transfer means, and after the image transfer, the photosensitive drum 1 is cleaned by the cleaning device 4 so that the remaining toner is removed to be prepared for the next image forming operation. The transfer material is fed to the photosensitive drum 1 from an unshown sheet feeding cassette, and after receiving the toner image from the photosensitive drum 1, the transfer material is fed to unshown fixing apparatus, where the toner image is fixed.

Referring to FIG. 2, the developing device 3 of this embodiment will be further described. In FIG. 2(A), a sleeve flange 15 is securely fixed to the developing sleeve 12 by press-fitting, bonding, crimping or the like. The sleeve flange 15 functions as a bearing, being fixed to the developing sleeve 12 to support the end of the developing sleeve 12 by a supporting member 52. At the opposite side of the developing sleeve 12 (right side), the sleeve flange 17 is similarly fixed. The boss portion is engaged with a bearing 18*a*, and sleeve gear 12*a* is mounted by key set screw or the like so that it is not rotated relative thereto. Therefore, the developing sleeve 12 is driven by the drum gear 1*a* mounted to the photosensitive drum 1 through the sleeve gear 12*a* to rotate in a predetermined direction.

The internal wall of the sleeve 12 is provided with a bias electrode 16. The bias electrode 16 is made of spring stainless steel plate, a phosphor bronze plate or the like, and as described hereinbefore, a plurality of claws are contacted to the inside surface of the developing sleeve 12 to establish an electric connection with the electrode plate 14 by the arm portion with a predetermined force. When the process cartridge is mounted to a predetermined position of the main assembly, the electrode plate 14 is brought into contact with the developing bias contact portion (not shown) of the main assembly to be supplied with electric energy from a developing bias electric energy supply device.

On the other hand, the magnet roller 19 in the developing sleeve 12 is in the form of a hollow cylinder having opposite ends supported by supporting members 51, 52. They support also the developing sleeve 12, and the developing sleeve 12 and the magnet roller 19 are supported by the same member.

The right-hand supporting member 51 has a configuration as shown in FIG. 3. As shown in FIG. 2, and end conical taper portion 51*b* is inserted into the magnet roller 19 to support the magnet roller 19 while being urged to the left. The central cylindrical portion is engaged with the inner side of the sleeve flange 17, and the flange portion 51*a* is press-fitted to the receptor 53*a* of the holder 53. The supporting member 52 for supporting the left side has a configuration as shown in FIG. 4, and an end portion is formed into a D-shaped portion 52*a* provided by cutting a part of a cylinder. The inner wall of the magnet roller 19 has a D-shape for engagement with the D-shape portion 52*a*. The magnet roller 19 urged by the supporting member 51 is abutted to the a surface 52*c* of the supporting member 52 of FIG. 4 at the left end thereof, by which the longitudinal position is determined. The flange portion 52*b* has a similar cut portion which is engaged with the receptor 54*a* of the holder 54 to be positioned in the circumferential direction.

Since the magnet roller 19 has a simple hollow cylinder, it can be used for a plurality of makes of the machines by changing the shape of the supporting member for supporting it. For example, in the case that there are several makes of the image forming machines for A4 size, the magnet roller may be all common, and the number, corresponding to the makes, of the shafts are prepared. This is advantageous over the case wherein the number, corresponding to the makes, of the magnets integral with the shafts are prepared.

As described above, the magnet roller and the developing sleeve are supported by the same supporting member. This is advantageous over the case in which it is supported by separate members, in that coaxiality can be improved very much. This enables the gap to be minimized between the outer surface of the magnet roller and the inner surface of the developing sleeve.

Embodiment 2

Figure 5:
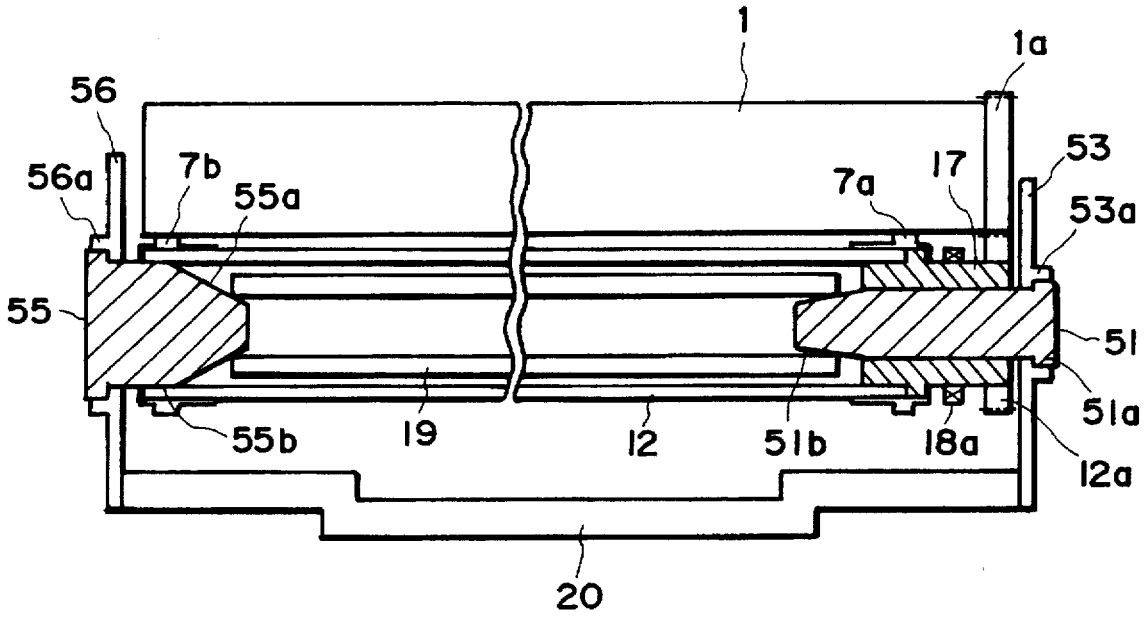
FIG. 5 is a partial sectional view of a developing device of another embodiment of the present invention.
Figure 6:
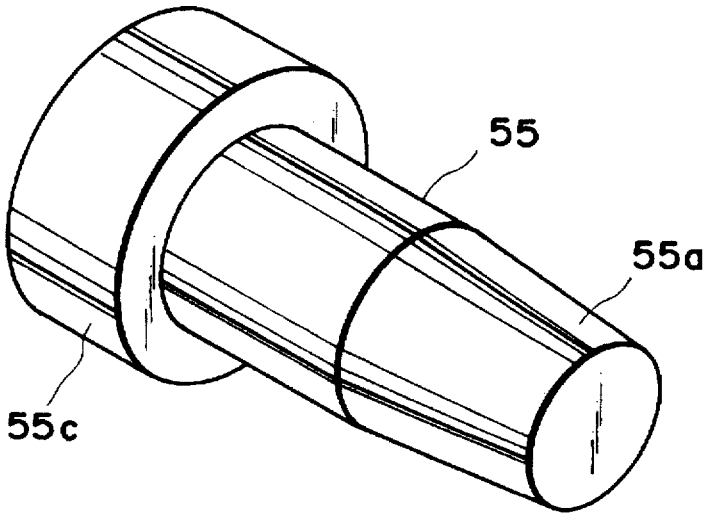
FIG. 6 is a perspective view of a supporting member.
Figure 7A:
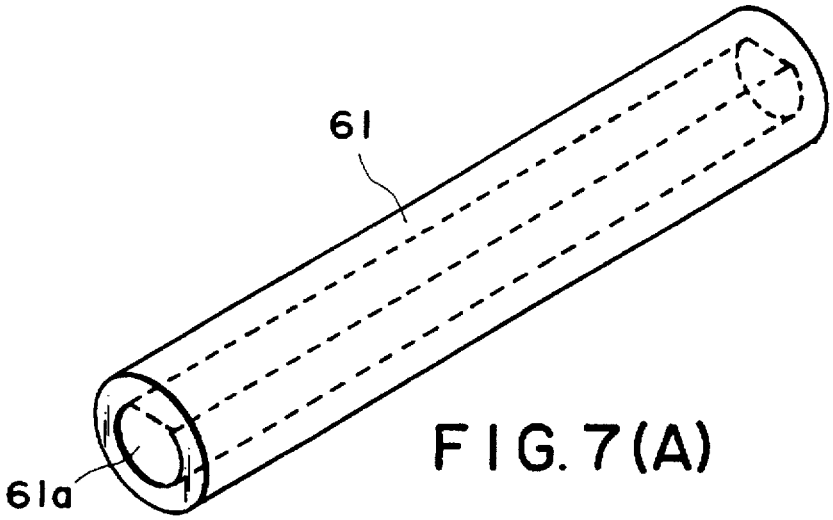
FIG. 7(A) is a perspective view of a magnet roller.
Figure 7B:
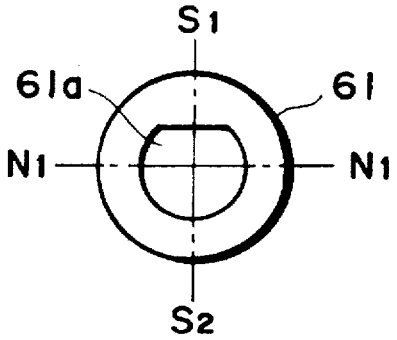
FIG. 7(B) is a sectional view thereof.

Referring to FIGS. 5 and 6, a second embodiment will be described. The same reference numerals as in embodiment 1 are assigned to the elements having the corresponding functions, and detailed descriptions thereof are omitted for simplicity.

In this embodiment, the developing sleeve and the magnet roller are supported in the similar manner as in the foregoing embodiment, but the other end if different. As shown in FIG. 5, the magnet is supported by the conical taper portion 55*a* similarly to said one end, and the central cylindrical portion receives the inside wall of the developing sleeve 19. The flange portion 55*c* is press-fitted to a receptor 56*a* of the holder 56.

The difference of this embodiment from the first embodiment is in that the supporting member 55 functions as the bias electrode for supplying the developing bias to the developing sleeve 12 and the electrode plate to be mounted to the holder 56. In this embodiment, the developing bias contact portion of the main assembly is contacted with the flange portion 56*a* of supporting member 55 of electroconductive resin material provided by mixing metal material such as stainless aluminum or the like or by mixing-carbon filler with a polyacetal resin material, to supply the electric energy through the inner support for the developing sleeve 12, when the process cartridge is mounted into the main assembly. By doing so, the bias electrode and the electrode plate an of embodiment 1 can be omitted, thus permitting significant cost reduction. In this embodiment, the press-fitting of a conical taper portion at each side is used to prevent rotation. However, the method of rotation prevention is not limiting, and the D-shaped portion of embodiment 1, for example, is usable. Also, in this embodiment, the magnet roller can be used for a plurality of makes of the machines.

Figure 11:
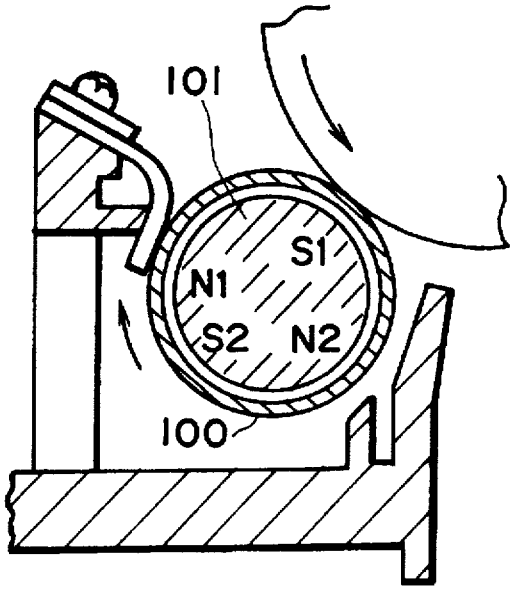
FIG. 11 is a sectional view showing the magnetic pole position of a magnet roller of the FIG. 10 device.
Figure 12:
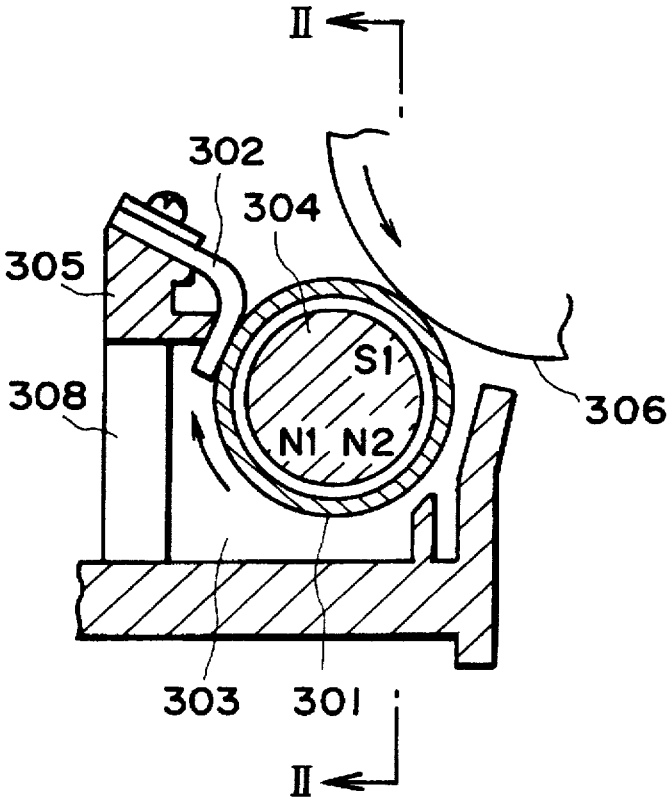
FIG. 12 is a sectional view of a developing device.
Figure 13:
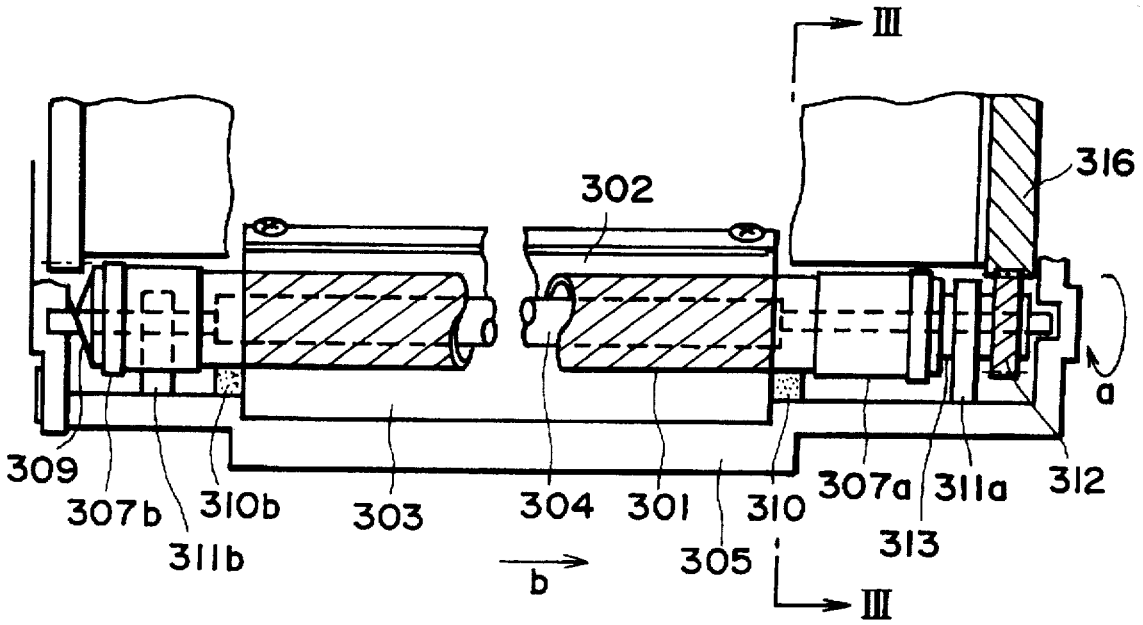
FIG. 13 is a sectional view of a developer carrying member and a bias electrode of the FIG. 12 device.
Figure 14:
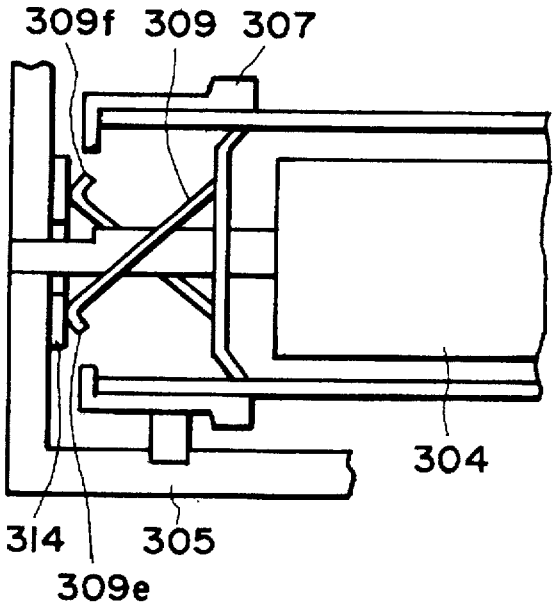
FIG. 14 shows the state of contact between the bias electrode and the electrode plate of the FIG. 12 device.
Figure 15:
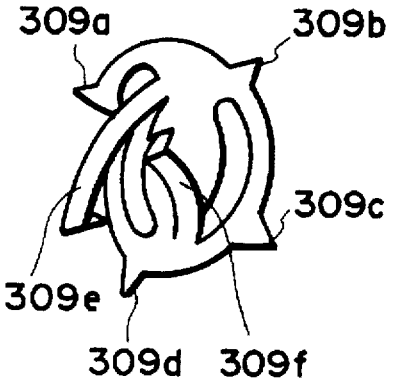
FIG. 15 is a perspective view of a bias electrode of the FIG. 12 device.

In embodiment 1, the D-shaped portion is provided at the left end as shown in FIGS. 2(A) and (B). With this type, the D-shape portions can be provided all around the internal circumference. In this case, as shown in FIG. 11, a development pole S1 is required to have the strongest magnetic force. It is preferably disposed at the thick portion above the D-shaped portion since then strong magnetic force can be provided.

Figure 8A:
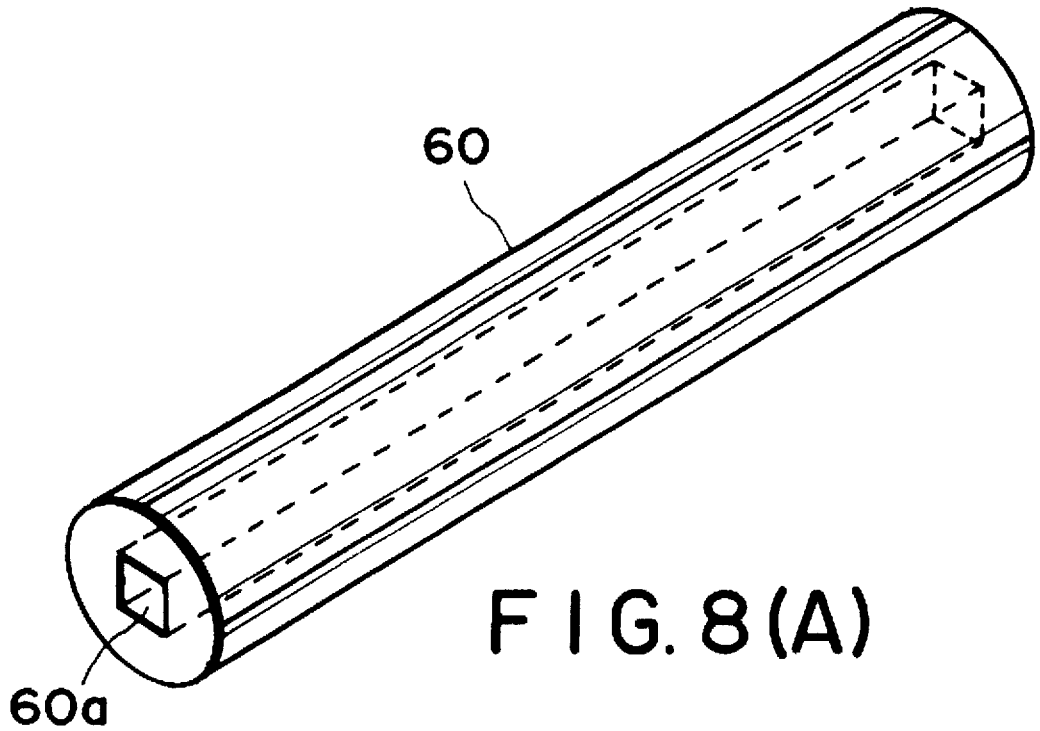
FIG. 8(A) is a perspective view of a magnet roller.
Figure 8B:
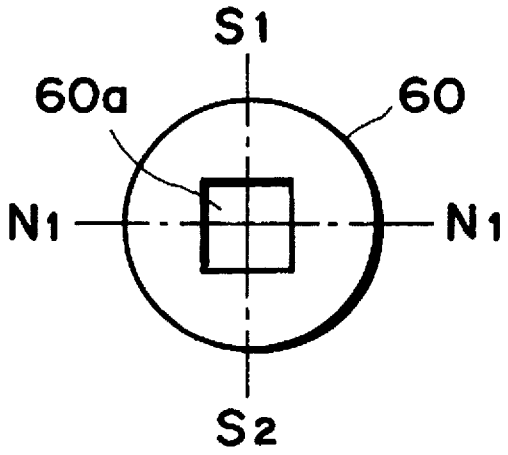
FIG. 8(B) is a sectional view thereof.
Figure 9:
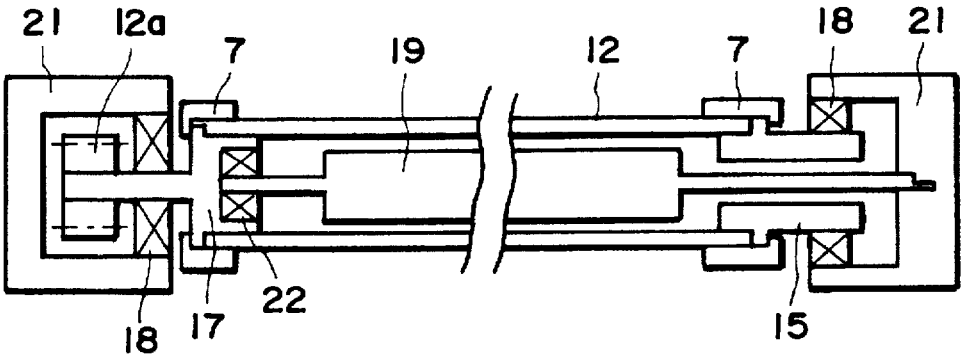
FIG. 9 is a sectional view of a developing device wherein a flange and a magnet roller are in sliding movement relation.
Figure 10:
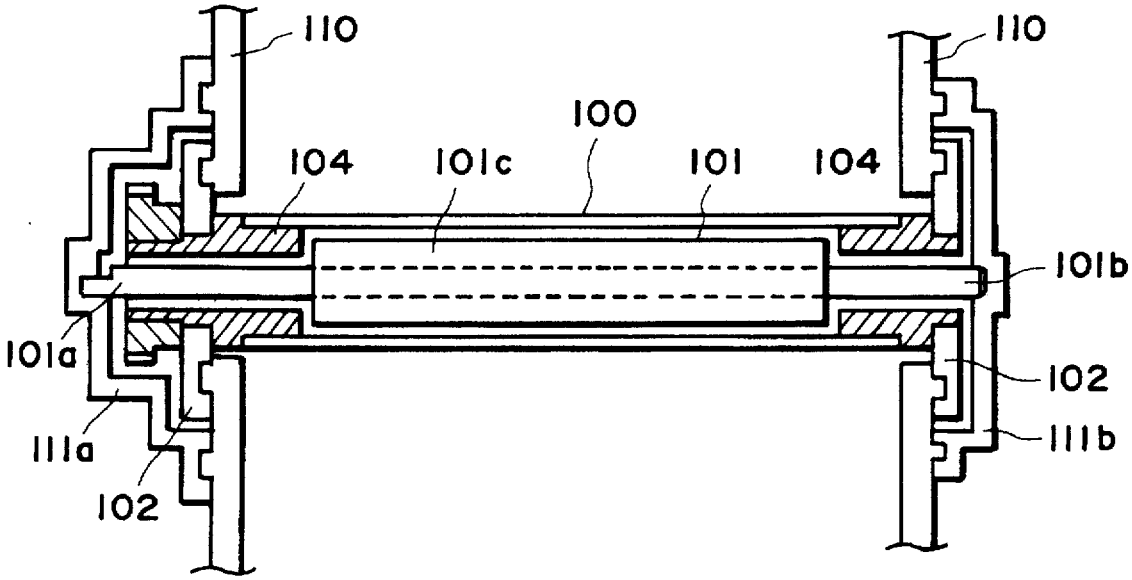
FIG. 10 is a sectional view of a conventional apparatus wherein an end surface of a shaft portion of a magnet roller is used as a thrust receiving surface.

Similarly, as shown in FIGS. 8(A) and (B) the internal wall may be shaped into a square or rectangular shape 60*a*, in which case, the development pole S1 is disposed at the thick portion since then the stronger magnetic force can be provided. The shape of the internal wall may be triangular or another polygonal shape.

While the invention has been described with reference to the structures disclosed herein, it is not confined to the details set forth and this application is intended to cover such modifications or changes as they may come within the purposes of the improvements or the scope of the following claims.

What is claimed is:

1. A developing apparatus comprising:

a developing sleeve for carrying a developer;

a flange provided at an end of said developing sleeve, said flange having an inner surface functioning as a bearing surface;

a hollow magnet roller provided in said sleeve;

an insertion member inserted through said magnet roller to stationarily fix said magnet roller, said insertion member being engaged with the inner surface of said flange.

2. An apparatus according to claim 1, wherein said insertion member is provided at each of opposite ends of said magnet roller.

3. An apparatus according to claim 1, wherein said insertion member securedly supports said magnet roller and rotatably supports said developing sleeve.

4. An apparatus according to claim 3, wherein a bore of said magnet roller has a cross-section for preventing rotation.

5. An apparatus according to claim 4, wherein the bore has a rectangular cross-section.

6. An apparatus according to claim 1, wherein a bias voltage is applied to said developing sleeve through said insertion member.

7. An apparatus according to claim 1, wherein said insertion member has a tapered portion to be inserted into said magnet roller.

* * * * *

UNITED STATES PATENT AND TRADEMARK OFFICE

CERTIFICATE OF CORRECTION

PATENT NO. : 5,682,587

DATED : October 28, 1997

INVENTOR(S) : HIGETA ET AL.

It is certified that error appears in the above-identified patent and that said Letters Patent is hereby corrected as shown below:

Column 1

Line 24, "press-filled" should read --press-fitted--;
Line 26, "bios" should read --bias--;
Line 31, "from" should read --from a--;
Line 49, "and" should read --and a--;
Line 51, "10" should read --101--;
Line 54, "plurality of more particularlys" should read --plurality of magnets more particularly--;
Line 55, "101*d*" should read --101*a*--; and
Line 58, "assembly of the 110" should read --assembly 110 of the--.

Column 2

Line 1, "therein with" should read --therein--;
Line 3, "pole" should read --poles--;
Line 6,7, ""roller s 307*a*, 307*b* which functions" should read --rollers 307*a*, 307*b* which function--;
Line 11, "d developing" should read --developing;
Line 24, "are" should read --is--;
Line 51, "apart" should read --a part--;
Line 53, "between the developing sleeve 301" should read --between the developing sleeve 301 and the photosensitive drum 306--; and
Line 67, "apparatus" should read --apparatus of--.

UNITED STATES PATENT AND TRADEMARK OFFICE

CERTIFICATE OF CORRECTION

PATENT NO. : 5,682,587

DATED : October 28, 1997

INVENTOR(S) : HIGETA ET AL.

It is certified that error appears in the above-identified patent and that said Letters Patent is hereby corrected as shown below:

Column 3

Line 9, "FIG." should read --FIGS.--;
Line 10, "portion s" should read --portions--;
Line 13, "309*a*" should read --309*e*--;
Line 22, "determined" should read --determines--;
Line 48, "the" should read --be--; and (3rd occurrence)
Line 62, "develope" should read --developer--.

Column 4

Line 12, "of" should read --of a--; and
Line 49, "of" should read --of a--.

Column 5

Line 2, "to" should read --to the--; (2nd occurrence)
Line 21, "through" should read --through an--;
Line 46, "by" should read --by a--; and
Line 52, "of" should read --of a--.

UNITED STATES PATENT AND TRADEMARK OFFICE

CERTIFICATE OF CORRECTION

PATENT NO. : 5,682,587

DATED : October 28, 1997

INVENTOR(S) : HIGETA ET AL.

It is certified that error appears in the above-identified patent and that said Letters Patent is hereby corrected as shown below:

Column 6

Line 2, "and" should read --an--;
Line 14, "the a" should read --the--;
Line 45, "if" should read --is--;
Line 59, "mixing-carbon" should read --mixing carbon--; and
Line 64, "an" should be deleted.

Column 8

Line 4, "sleeve;" should read --sleeve; and--.

Signed and Sealed this

Thirteenth Day of October 1998

*Attest:*

*Attesting Officer*

Bruce Lehman

BRUCE LEHMAN

*Commissioner of Patents and Trademarks*